United States Patent [19]

Weisshaar

[11] 4,092,521

[45] May 30, 1978

[54] MENSTRUAL CALCULATOR

[76] Inventor: Manfred E. Weisshaar, 917 Greendale Dr., Windsor, Ontario, Canada, N8S 4B2

[21] Appl. No.: 682,959

[22] Filed: May 4, 1976

[51] Int. Cl.[2] ..... G06C 3/00

[52] U.S. Cl. ..... 235/88 RC

[58] Field of Search ..... 235/78 RC, 85 FC, 88 RC

[56] References Cited

U.S. PATENT DOCUMENTS

| | | | |
|---|---|---|---|
| 2,118,354 | 5/1938 | Mansur | 235/85 FC |
| 2,476,100 | 7/1949 | Lancaster | 235/85 FC |
| 2,638,272 | 5/1953 | Heck | 235/85 FC |
| 2,792,177 | 5/1957 | Ker | 235/88 RC |

FOREIGN PATENT DOCUMENTS

| | | | |
|---|---|---|---|
| 1,316,523 | 12/1962 | France | 235/85 FC |

*Primary Examiner*—Lawrence R. Franklin
*Attorney, Agent, or Firm*—Michael M. Sakovich

[57] ABSTRACT

A dial calculator for determining periods of fertility and sterility in a menstrual cycle of a human female. In one embodiment, the calculator includes first and second discs each having an annular display of first indicia representing thirty-one days of a calendar month. The second disc is smaller than the first disc and is adapted to be rotatably set in coaxial relation with the first disc so that the indicia of the second disc follow consecutively any one of the indicia on the first disc. A third disc is adapted to be rotatably set in coaxial relation with the second disc in respect of any one of the indicia on the first disc. The third disc is smaller than the second disc and includes an annular display of second indicia representing at least the days of a normal menstrual cycle including the periods of fertility and sterility and relates such days to the consecutively arranged indicia of the first and second discs. The three discs are simple to operate and display the indicia in improved form. Another embodiment includes a fourth disc overlying the innermost disc for setting the periods of fertility and sterility relative to the day of onset of the next following menstrual cycle when such day is variable.

12 Claims, 6 Drawing Figures

MENSTRUAL CALCULATOR

BACKGROUND OF THE INVENTION

The present invention relates to menstrual calculators and more particularly to a dial type calculator for determining periods of fertility and sterility in a menstrual cycle and relating such data to the days of two consecutive months over which the menstrual cycle usually occurs.

Manually operated calculators, both of the dial type and linear type, are well known in the art of menstrual calculators. Based on available statistical data, such calculators are used to predict the onset of a menstrual cycle that follows a current menstrual cycle and to indicate periods of fertility and sterility within the current cycle.

The prior art shows that the foregoing devices are based on statistical reports of medical studies which reveal the existence of a rhythmic pattern between ovulation and the onset of the next menstrual cycle. During the menstrual cycle, the period of fertility is related to ovulation which occurs with the rupture of a Graafian follicle and the attendant release of an ovum. This natural event forms the basis of the "rhythm system" which is a widely practiced method for family planning. There are other methods for family planning which are also widely practiced and include orally ingested steroids as well as known mechanical devices that are available for either the male or female member of a married couple. The effect of these devices provides a reliable means for birth control. Nevertheless, for many couples recourse to any method other than the rhythm method is unacceptable due to religious, aesthetic or psychological reasons. The rhythm method for many couples is therefore the only solution to family planning.

The basis of the rhythm system is founded upon assumptions derived from currently available medical data. Medical studies indicate that ovulation occurs fourteen to sixteen days prior to menstruation. The prior art tends to be in agreement in this respect. Having determined the date of ovulation merely by counting backwards, fourteen, fifteen or sixteen days from the onset of the next following menstrual cycle, other factors must then be taken into account in order to determine with reasonable certainty periods of fertility and sterility within the current menstrual cycle. However, there appears to be some divergence in the prior art as regards the factors which govern the length of the fertile period during any menstrual cycle.

There is general agreement that the duration of the fertile period and its location within the current menstrual cycle varies in accordance with the date of onset of the next following menstrual cycle. While ovulation and menstruation are parts of the same cycle, statistics have shown that the time of ovulation is more directly related to the onset of the following menstrual cycle than to the preceding cycle. Since the date of onset of the next cycle is never known, only an estimate can be used. This date therefore comprises a variable quantity which is best estimated by reference to the past history of a woman's menstrual periods.

Further variables occur which also affect the periods of fertility and sterility in the menstrual cycle. It has been stated that ovulation occurs between fourteen and sixteen days prior to the next menstrual cycle. It is apparent, therefore, that there are two variables here, the first being the prediction of the onset of the next menstrual cycle and the second being the selection of one of the three days during which ovulation is expected to occur.

Still other variables complicate the situation due to the life span of the male sperm which is estimated to be between two and three days and the life span of the female ovum which is estimated to be twenty-four hours. It is apparent that the life span of the male sperm extends the fertility period to approximately the nineteenth day before onset of the next menstrual cycle whereas the life span of the ovum brings the fertile period to eleven days prior to the onset of the next menstrual cycle. A safety factor is then usually added to the first and last days of the fertility cycle to take into account such effects as the menstrual period not starting at the beginning of the day. Accordingly, the fertile period may occur from eleven through twenty days prior to the onset of the next following menstrual cycle. It is thus apparent that a calculation to determine the fertile and sterile periods occurring during the menstrual cycle is at best difficult. Moreover, the calculation is further complicated by physchological factors which can affect initiation of ovulation.

Many prior art calculators have been developed in an effort to introduce variable compensation to account for the aforenoted variables. The end result, however, is often a complicated device having generally a multiplicity of scales or at best a reduced number of scales but with a large number of graduations on some of the scales used. The result is a calculator device that appears confusing to the eye and is therefore difficult to read. Moreover, such a device generally has a large number of dial graduations which makes it still more difficult to read, particularly if the device is small in size. Furthermore, since there are a number of variables that must be considered and such variables are affected by psychological factors that may vary from day to day, the accuracy of the results obtained may rightly be questioned; particularly so in light of the complexity of the device and the difficulties experienced in using it.

A perfectly normal menstrual cycle has a duration of twenty-eight days. However, the range of a normal menstrual cycle may vary from twenty-six to thirty days. Some of the prior art literature, however, specifies that most menstrual cycles are between twenty-two and thirty-four days in length and vary from month to month by from two to eight days. It is apparent therefore that the menstrual cycles of most women vary continually and that they are predictable between points of maximum and minimum duration. Statistical studies have shown that for a woman who has menstrual cycles ranging from twenty-six to thirty-one days in length, more of her cycles will be twenty-eight and twenty-nine days rather than twenty-six, twenty-seven, thirty or thirty-one days.

The foregoing suggests that a statistically average woman could reliably use a fertility calculator that is more simple in construction than similar calculators in the prior art by virtue of the absence of compensating scales needed to adjust the period of fertility because of the variables. Since the normal menstrual cycle variation may be only about two days, it should be possible to provide a more simple calculator having good reliability for the woman whose cycles range between twenty-eight and twenty-nine days.

STATEMENT OF THE OBJECTS OF THE INVENTION

It is an object of the present invention to provide a simple menstrual calculator that is compensated for variable factors affecting the fertile and sterile periods of a menstrual cycle.

Another object of the present invention is to provide a simple menstrual dial calculating device which is small in size and which provides improved legibility of indicia appearing on the dial scales.

The invention also provides that the days of a current menstrual cycle be directly related to the days of any two consecutive calendar months irrespective of the numbers of days appearing in the first month.

A further object of the invention is to provide an embodiment which incorporates the aforenoted features of the invention and which includes a compensating scale to more accurately predict periods of fertility and sterility in a current menstrual cycle.

SUMMARY OF THE INVENTION

The foregoing objects of the invention may be achieved and the difficulties of the prior art overcome by recourse to my invention which is a dial calculator for determining the periods of fertility and sterility occurring in a current menstrual cycle of a human female. The calculator comprises first and second discs divided into a plurality of equal segments with each disc having an annular display of first indicia disposed along substantially the entire periphery thereof, the indicia representing thirty-one days of a calendar month and occupying corresponding ones of the segments in the discs. The second disc is smaller than the first disc and is adapted to be rotatably set in coaxial relation with the first disc so that the indicia of the second disc follow consecutively on a shorter radius a first predetermined one of the indicia of the first disc. A third disc divided into a plurality of like equal segments is adapted to be rotatably set in coaxial relation with the second disc in respect of a second predetermined one of the indicia on the first disc. The third disc is smaller than the second disc and includes an annular display of second indicia disposed along substantially its entire periphery, the second indicia being arranged to display complete days following the second predetermined one of the indicia of the first disc and representing at least the days of a normal menstrual cycle including the periods of fertility and sterility. Such days are related to the consecutively arranged indicia of the first and second discs.

DESCRIPTION OF THE DRAWINGS

The invention will now be more completely described with reference to embodiments thereof shown, by way of example, in the accompanying drawings wherein.

DESCRIPTION OF THE ILLUSTRATED EMBODIMENTS

Figure 1:
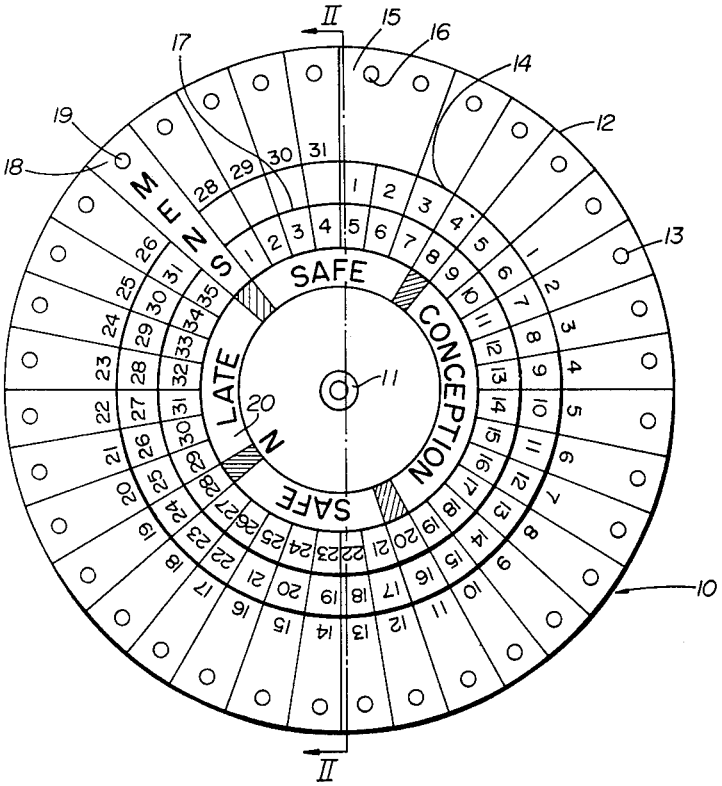
FIG. 1 is a plan view of a dial calculator in accordance with the present invention.
Figure 2:
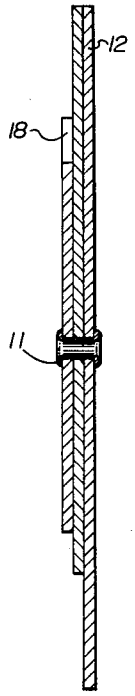
FIG. 2 is a sectional side view of FIG. 1 taken along the lines II—II.

A plan view of one embodiment of my dial calculator 10 is shown in FIG. 1. A sectional view taken along the line II—II and looking in the direction of the arrows is shown in FIG. 2. It will be seen that the calculator 10 comprises three circular discs which are coaxially arranged and are free to rotate about an eyelet 11 that holds the assembly together. It should be noted that the discs may be fabricated of any suitable material such as metal, plastic or paper. The choice of materials is not critical except that a material having a long life characteristic is preferred.

A first disc shown as a base disc 12 is conveniently constructed in the size illustrated in FIG. 1. The disc 12 is apportioned into thirty-six equal segments and includes an annular display of thirty-one days representing the longest calendar month. These days are shown by indicia that are disposed adjacent a portion of the periphery of the disc 12. Thus, only thirty-one of the thirty-six segments available are used. Each one of the segments includes a perforation 13 located immediately adjacent to the periphery of the disc 12.

The second disc of the calculator 10 is an intermediate disc 14 that is smaller in diameter than disc 12. Another characterizing feature of the disc 14 is a tab 15 portion that extends radially outwardly to the periphery of the disc 12. The tab 15 is adapted to be positioned in respect of a predetermined one of the indicia on the disc 12. In this way, the first one of the indicia on the disc 14 is below and immediately follows the predetermined one of the indicia on the disc 12 adjacent to which the tab 15 is set. It is apparent from FIG. 1 that the number of segments appearing on the disc 14 together with the indicia thereon are the same as that described for the disc 12. The tab 15 also includes perforations 16 which are aligned exactly with perforations 13 when the left-hand or leading edge of the tab 15 is placed adjacent to the right-hand or trailing side of a segment on the disc 12.

A third disc completes the structure of the calculator 10. This is an innermost disc 17 which is smaller in diameter than the intermediate disc 14. It will be seen that the disc 17 includes thirty-six segments each of which contains indicia ranging from numeral 1 through numeral 35. The thirty-sixth segment extends radially outwardly as a tab 18 to the periphery of the base disc 12. In like manner to the tab 15, the tab 18 includes a perforation 19 at its periphery which is adapted to coincide with any perforation 13.

The indicia of the disc 17 are displayed in an annular scale or band that includes at least the twenty-eight days of a normal menstrual cycle. As shown in FIG. 1, the indicia vary from numerals 1 through 35. The disc 17 includes another annular scale 20 which is disposed inwardly of the indicia representing the days of the normal menstrual cycle and indicates in combination therewith the day of onset for a next following menstruation cycle together with the days of fertility and sterility of the current menstrual cycle. It will be seen that the period of fertility is labelled "Conception" and is disposed on the scale 20 under numerals 9–19 which represent the days of the current menstrual cycle. The eighth and twentieth days which bound the period of fertility are underscored by shaded segments to indicate that they are coloured. Numerals 8 and 20 thus represent fringe areas of the fertility period during which the statistical probability of conception is reduced. The first non-fertile or sterile period in the menstrual cycle is shown in the scale 20 under numerals 1–7. A second non-fertile or sterile period is shown on the scale 20 under numerals 21–27. The onset of the next following menstrual cycle is shown under numeral 28 and a late period is shown under numerals 29–35. The thirty-sixth segment is underscored by means of a coloured segment on the scale 20 as is the twenty-eighth day of the cycle which represents the onset of the next normal menstrual cycle. Late days following the twenty-eighth day appear on the scale 20 under numerals 29–35.

The operation of the calculator 10 will be completely understood by reference to the following description. Firstly, the tab 15 of the disc 14 is set to the last day of the month on disc 12 in which the onset of the current menstruation cycle occurs. It will be noted that the left-hand side or leading edge of the tab 15 is brought adjacent to the right-hand side or trailing side of the segment containing the numeral 31 on the disc 12. Although this indicates that the current menstrual cycle has its onset in a month having thirty-one days, it should be understood that the calculator 10 may be used with equal facility during any month including those months having twenty-eight, twenty-nine or thirty days.

Having set discs 12 and 14 as described, the discs may be locked together by any convenient means which may include a common safety pin that is passed through any pair of aligned perforations 13 and 16. This provides a memory feature since the relationship of the discs is retained.

Figure 6:
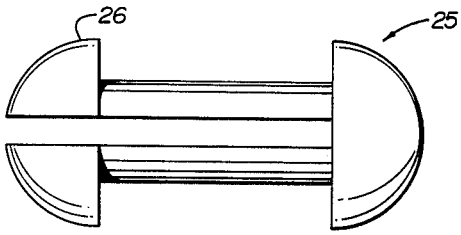
FIG. 6 is a side view of a locking pin for use with the embodiments of the present invention.

Another form of locking device is shown in FIG. 6. This is a split pin 25 having a pair of anchor flukes 26. As the pin 25 is inserted through the perforations, the sides of the pin are brought together as a result of the slot therebetween which allows the flukes 26 to pass through the perforations. Having passed through, the sides spring apart and permit the flukes 26 to lock the pin 25 in place. Removal of the pin 25 is easily performed simply by grasping the flukes 26 and compressing the sides of the pin while withdrawing same from the perforations.

Once the discs 12 and 14 are set and locked together, the disc 17 is rotated by means of its tab 18; the tab being placed directly on a segment of the disc 12 which bears the date of the month in which the current menstrual cycle has its onset. Thereafter, the tab 18 is locked to the disc 12 by means of another pin 25 which is passed through a pair of registered perforations 19 and 13.

It has been assumed that the onset of the current menstrual cycle occurred on the twenty-seventh day of the thirty-one day month shown in this example. The calculator 10 may now be used to determine which days of the current cycle are fertile and sterile by referring to the numerals displayed on the disc 17 and to the scale 20. In addition, the scale 20 gives an indication of the day of onset of the next following menstrual cycle, and the days of lateness following the day of onset should such cycle not be initiated on the expected day. All days of the current menstrual cycle including the days shown as being the late days following the expected onset of the next following menstrual cycle are readily related to calendar dates simply by referring to the date displays in the annular bands of discs 12 and 14. In the example described, the onset of the current menstrual cycle occurs on the twenty-seventh day of the current month. The first four days of the menstrual cycle then occur on the twenty-eighth, twenty-ninth, thirtieth and thirty-first of that month. Dropping down to the date index on the disc 17, the fifth day of the current menstrual cycle occurs on the first day of the next following month. It will be seen that the sterile period preceding the fertile period occurs on the last four days of the month in which the current menstrual cycle starts as well as the first three days of the next following month. The day prior to the fertile period occurs on the fourth day of the following month and the fertile period runs from the fifth to the fifteenth day of that month. The twentieth day of the current menstrual cycle bounds the trailing end of the fertile period and occurs on the sixteenth day of the following month. Thereafter, a sterile period occurs on the twenty-first through the twenty-seventh day of the current menstrual cycle which corresponds to the seventeenth through the twenty-third days of the next following month.

The onset of the next following menstrual cycle is expected to normally occur on the twenty-eighth day of the current menstrual cycle. This corresponds to the twenty-fourth day of the next following month. Days of lateness thereafter vary on the scale 20 from the twenty-ninth day through the thirty-fifth and are represented by calendar days twenty-five through thirty-one of the next following month which is shown on the disc 14.

In the different embodiments of the drawings, it is proposed to show the various portions of the scale 20 in different colours to clearly distinguish the divisions in the menstrual cycle. The fertile period of the cycle is labelled "Conception" and is displayed in some bright colour such as red. The sterile periods of the cycle are each labelled "Safe" and are displayed in a different colour to readily distinguish from the fertile period. Divisions between the fertile and non-fertile periods are shown by coloured segments. Since the days represented by such segments are uncertain in respect of fertility or infertility in the menstrual cycle, a cautionary yellow colour is used. An appropriate colour for the segments underscoring the onset of the current menstrual cycle and that of the next following cycle is green. The late period of the scale 20 may be coloured in any other suitable colour in order to distinguish from the earlier described portions of the scale.

It will be seen that the tab 18 is labelled "MENS" to indicate that it represents the onset of the current menstrual cycle. An appropriate colour here would be green to correspond to the coloured segment appearing below the letter S. It should be noted that adjacent to the coloured segment between the portions labelled safe and late on the scale 20 there is a designation N. The purpose of this designation is to indicate the normal day of onset for the next following menstrual cycle.

A ten day fertile period has been established on the basis of current empirical medical knowledge. It will be seen that the scale 20 is calibrated to show that conception may occur any time from the ninth to the nineteenth day of the menstrual cycle, a total of eleven days. Added to this is the eighth and twentieth day which are uncertain days giving a total of thirteen days during which conception may occur in the cycle. The calculator 10 therefore includes three extra days in that portion of the scale 20 which indicates fertility and thus compensates for variations in the onset of the next menstrual cycle by one day on each side of the twenty-eighth day of the current cycle. The result is a calculator that is simple in design and operation since only three discs are employed in its structure. Since the date of onset for the next following menstrual cycle is the critical date in respect of determining periods of fertility and sterility, and since such date can only be estimated by reference to the prior history of the individual, and since past indications may vary for the onset of the next cycle due to psychological reasons as previously discussed, it is believed that the menstrual calculators of the prior art which employ adjustable compensation means in an effort to establish the fertility period with improved accuracy may at times be ineffective due to the variable nature of such critical date. Accordingly, it is believed that the fixed scale 20 used in the calculator 10 provides comparable accuracy for many women and does so while providing the advantage of a simplified calculating device that is not only more convenient to use but is also more economical to manufacture.

Figure 3:
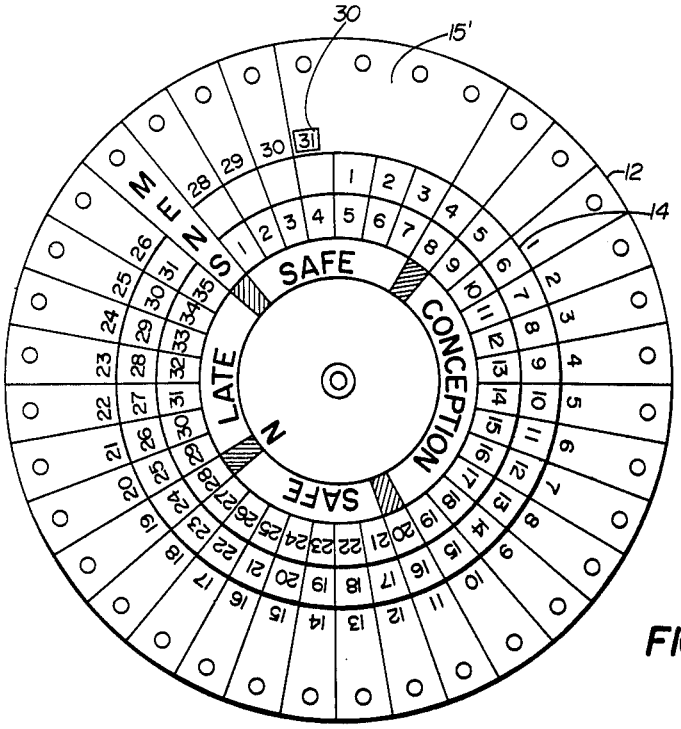
FIG. 3 is a plan view of a further embodiment of the present invention.

In FIG. 3 there is shown another embodiment of the calculator 10 of FIG. 1. The scales of these embodiments are identical except that in the embodiment of FIG. 3 the segmented divisions of a disc 14' are displaced clockwise by one segment relative to the disc 14 of FIG. 1. The reason for such displacement is to allow a slightly different arrangement in positioning a tab 15'. It will be seen that this tab includes a window 30 which is used to frame the last day of the month appearing on the disc 12. A comparison of the embodiments shown in FIGS. 1 and 3 will reveal that the operation of the two is the same since the first date of the next following month which appears on the disc 14' immediately follows the date framed by the window 30. A further minor modification appears in the tab 15' which occupies a space of four segments rather than the two segments of tab 15 in FIG. 1. The reason for this modification is to add structural rigidity to the tab, a variation which may be applied to any of the embodiments described.

Figure 4:
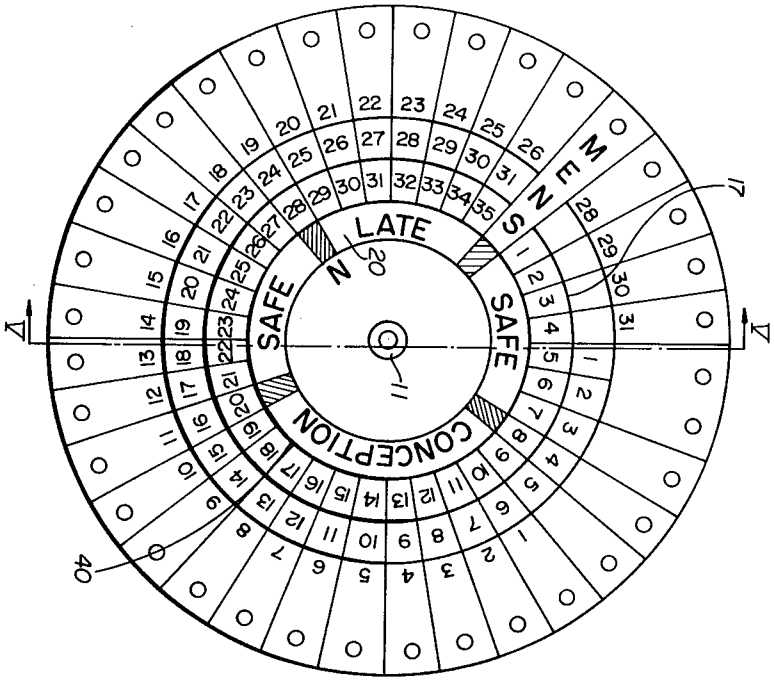
FIG. 4 is a plan view of still another embodiment of the present invention and includes an adjustable disc to compensate for variables that affect the periods of fertility and sterility occurring in a current menstrual cycle.
Figure 5:
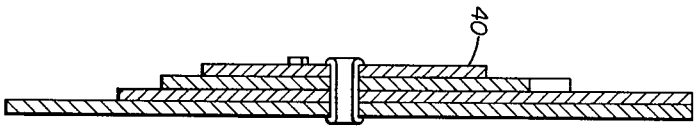
FIG. 5 is a sectional view of FIG. 4 taken along the lines V—V.

A further embodiment appears in FIG. 4 of the drawings and is shown to comprise four discs. This embodiment is substantially the same as that appearing in FIGS. 1 and 3 but differs by the inclusion of a fourth disc 40. The purpose of the disc 40 is to provide a simplified means for compensating the calculator 10 when the critical date of onset of the next menstrual cycle exceeds the aforenoted limits referred to in the operation of the calculator 10. Thus, in the event that the critical date is expected to occur on a day earlier than the twenty-seventh day of the current menstrual cycle or later than the twenty-ninth day of the cycle, the disc 40 compensates for this variation. Such compensation occurs by rotating the disc 40 and setting the segment underscored by the letter N to the day within the current menstrual cycle that the onset of the next following cycle is expected to occur. As a result of such rotation, the conception portion of the scale 20 rotates to align with the appropriate days of the cycle. Similarly, the safe and late portions of the scale 20 likewise align responsive to rotation of the disc 40.

The operation of the disc 40 in the embodiment of FIG. 4 is quite simple and may be readily understood. For example, in the event that the onset of the next following menstrual occurs on the twenty-sixth day, then the letter N underscored segment of the disc 40 is brought adjacent to the segment on the disc 17 which displays this day. Rotation of the disc 40 is assisted by providing a raised portion thereon which constitutes the foregoing letter N. The fertile period in the menstrual cycle then occurs from the seventh to the seventeenth day within the cycle which corresponds to the third through the thirteenth day of the next following month.

Figure 7:
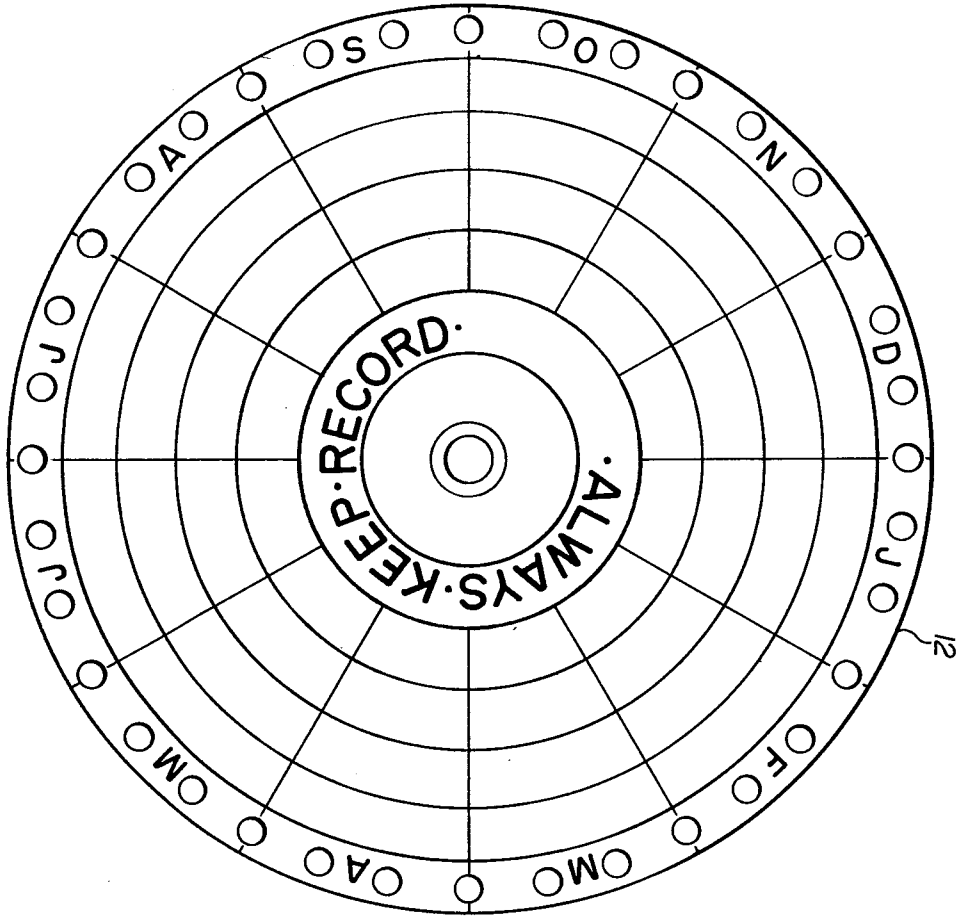
FIG. 7 is a plan view of the reverse side of the dial calculator of FIG. 1.

FIG. 7 indicates the reverse side of the disc 12 and is used in each embodiment of the invention described. It will be noted that this side is provided with a writing surface that may include a lamina of paper. Alternatively, in the event that the disc 12 is manufactured of plastic material, the reverse side may be roughened in a known manner to provide a matt writing surface for either a pencil or ballpoint pen. There are twelve segments, each representing a different cycle. The segments are labelled as to the cycle which they represent and are ruled to provide space for recording menstrual data. Space is provided for forty-eight such entries. This is a convenient feature since pertinent data is always maintained with the calculator from which such data is obtained.

What I claim is:

1. A dial calculator for determining periods of fertility and sterility in a current menstrual cycle of a human female, comprising:

first and second discs divided into a plurality of equal segments with each disc having an annular display of first indicia disposed along substantially the entire periphery thereof, said indicia representing thirty-one days of a calendar month and occupying corresponding ones of the segments in the discs, the second disc being smaller than the first disc and adapted to be rotatably set in coaxial relation therewith so that the indicia of the second disc follow consecutively on a shorter radius a first predetermined one of the indicia of the first disc; and a third disc divided into said plurality of equal segments and being adapted to be rotatably set in coaxial relation with the second disc in respect of a second predetermined one of the indicia on the first disc, the third disc being smaller than the second disc and including an annular display of second indicia disposed along substantially the entire periphery thereof, said second indicia being arranged to display complete days following said second predetermined one of the indicia of the first disc and representing at least the days of a normal menstrual cycle including the periods of fertility and sterility and relating said days to the consecutively arranged indicia of the first and second discs.

2. A calculator as claimed in claim 1 further comprising:

a tab portion on the second disc extending radially outwardly to the periphery of the first disc and adapted to be positioned in respect of a predetermined one of the indicia of said first disc; and a tab portion on the third disc extending from a segment thereof that separates the first and last indicia of said cycle for indicating the onset of the current menstrual cycle and extending radially outwardly to the periphery of the first disc and adapted to be disposed in registered alignment with any one of the indicia thereon.

3. A calculator as claimed in claim 2 wherein the third disc includes an annular scale disposed inwardly of the indicia of said cycle and indicates in combination therewith the day of onset for a next following menstrual cycle and the days of said fertility and sterility periods.

4. A calculator as claimed in claim 3 further comprising means for securing said discs in coaxially rotatable relation.

5. A calculator as claimed in claim 4 further comprising means for locking said tab portions to the first disc in a predetermined fixed relation.

6. A calculator as claimed in claim 5 wherein each disc is apportioned into thirty-six uniform segments which separate the indicia displayed thereon.

7. A calculator as claimed in claim 6 wherein the tab portion of the second disc includes a window adapted to be placed in registry with any segment of the first disc.

8. A calculator as claimed in claim 6 wherein the tab portion of the second disc includes a leading edge adapted to be placed adjacent a trailing side of any segment of the first disc.

9. A calculator as claimed in claim 8 further comprising a writing surface on the reverse side of the first disc apportioned into twelve equal segments for recording menstrual data thereon.

10. A calculator as claimed in claim 8 wherein the means for locking includes a perforation in each segment of the first disc within said portion of the periphery of said disc, a corresponding perforation in each of the tab portions and a pin adapted to lockably fit the corresponding perforations of each tab portion and first disc.

11. A calculator as claimed in claim 8 wherein the indicia of any disc are differently coloured from the indicia of an adjoining disc.

12. A calculator as claimed in claim 6 wherein a fourth disc at least partly overlies the third disc in coaxially rotatable relation, said fourth disc including at least a portion of the annular scale indicating the days of fertility and a tab portion settable to the day of onset of the next following menstruation period for setting the days of fertility with respect thereto.

* * * * *